United States Patent [19]

Smith

[11] 4,321,803

[45] Mar. 30, 1982

[54] MULTIPLE AIR PASSAGE CONDENSER

[75] Inventor: Hayden N. Smith, Jackson, Mich.

[73] Assignee: Addison Products Company, Addison, Mich.

[21] Appl. No.: 96,899

[22] Filed: Nov. 23, 1979

[51] Int. Cl.[3] ..... F25B 39/04

[52] U.S. Cl. ..... 62/507; 62/508; 62/506; 62/298; 165/76; 165/125

[58] Field of Search ..... 62/298, 505, 506, 507, 62/508; 165/76, 125, 156, 163, 184, 128, 148

[56] References Cited

U.S. PATENT DOCUMENTS

| | | | |
|---|---|---|---|
| 1,381,056 | 6/1921 | Blakely | 62/508 |
| 2,311,947 | 2/1943 | Kucher | 62/115 |
| 3,173,479 | 3/1965 | Hever | 62/507 |
| 3,498,080 | 3/1970 | Campbell | 62/285 |
| 3,555,848 | 1/1971 | Johnson | 62/508 |
| 3,908,393 | 9/1975 | Eubank | 62/305 |
| 3,943,728 | 3/1976 | Maudlin | 62/507 |

FOREIGN PATENT DOCUMENTS

| | | | |
|---|---|---|---|
| 976118 | 3/1951 | France | 62/508 |

*Primary Examiner*—Albert J. Makay
*Assistant Examiner*—Henry Bennett
*Attorney, Agent, or Firm*—Beaman & Beaman

[57] ABSTRACT

An air-cooled condenser having cooling face areas so configurated as to form two closed or substantially closed nested loops in spaced relation to provide a common inlet air duct between the face areas communicating with an air mover; the cooling air passages through the loops being in generally opposed relation down stream from the common inlet duct. In one embodiment a section of the outer loop is displaceable for servicing the compressor.

13 Claims, 7 Drawing Figures

MULTIPLE AIR PASSAGE CONDENSER

BACKGROUND OF THE INVENTION

In the air conditioning of living and other space it is the usual practice to locate an evaporator heat exchanger coil in the space to be cooled and to locate the refrigerant condensing heat exchanger coil where the collected heat may be dissipated into the ambient air.

Usually the compressor is located in the same housing as the condenser and the condenser-compressor unit normally includes and electrically driven air mover. Servicing requirements of the compressor and air mover has influenced the configuration of the condenser face areas. See U.S. Pat. No. 3,943,728.

It has also been proposed to form a flat condenser face area into a spiral form as shown in U.S. Pat. No. 3,173,479 to provide spaced concentric face areas having a common inlet duct within the face areas in contrast to being located between the face areas.

SUMMARY OF THE INVENTION

It is the object of the invention to more efficiently utilize the present practice of increasing the condenser face area to reduce the work of the compresser and conserve energy. As presently practiced, however, this technique is causing condensing units of a given heat transfer rating to become very large in physical size with accompanying increases in housing, packaging, shipping and warehousing costs.

A commonly used indication of energy consumption or efficiency in this art is the energy efficiency ratio (EER) in btu's/watt. In the past, the average EER for products in this art has been in the order of 6.5. The U.S. Department of Energy is now proposing by the year 1985 an EER in the order of 10.3, an increase of 3.8 btu's/watt. Under the aforesaid technique, as practiced, the condenser face area must be increased by a factor in the order of 2.4 and the cubic volume of the condenser is increased by the factor in the order of 2.8.

According to the present invention the amount of condenser face area has been increased with an improvement in EER within a given cubic volume. In general, the practice of the invention will limit the increase in cubic volume to a factor in the order of 1.5 as compared to a factor of 2.8. This is accomplished by employing two coils each of which is configured to form a closed or substantially closed loop. These closed loop coils are positioned relative to each other such that the space between them becomes a common inlet air duct to the fan or air mover.

Two embodiments are illustrated in presenting the preferred form of the invention in order to illustrate the use of a displaceble loop section for servicing the compressor. In practice, the loops are preferably closed and a continuous coil or coils used to provide the face area of the condenser structure.

It is to be understood that the geometry of the condensing units set forth in detail in the drawing and specification has the same advantages when applied to so called package units wherein the condensing unit is combined with an evaporator and an evaporator air system to provide a total air conditioning function in a single product.

BRIEF DESCRIPTION OF THE DRAWING

The aforementioned objects and advantages of the invention will be appreciated from the following description and accompanying drawing wherein.

DESCRIPTION OF THE PREFERRED EMBODIMENTS

The embodiments shown in FIGS. 1–3 and FIGS. 4–5 are only two variations by which the inventive concepts may be practiced, and it is to be appreciated that the novel aspects of the invention may be enjoyed with a variety of condenser heat exchanger coil configurations defining closed of substantially closed loops in nested relation.

Figure 1:
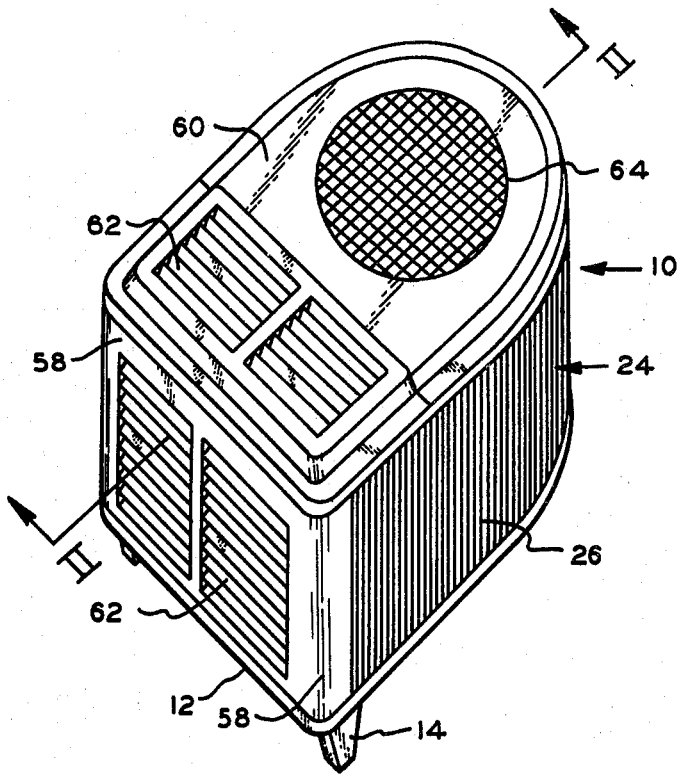
FIG. 1 is a perspective view of one embodiment of a condenser in accord with the invention illustrating the exterior appearance.
Figure 2:
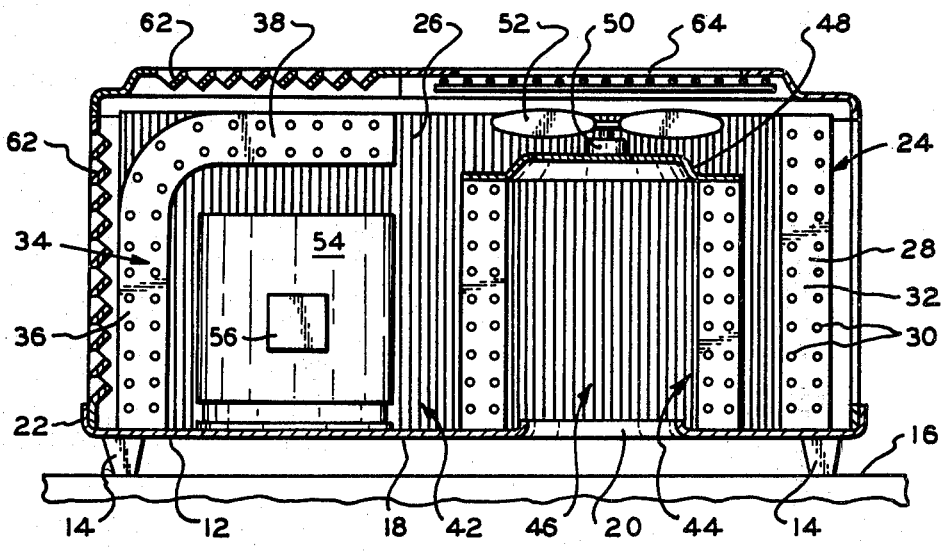
FIG. 2 is an elevational, sectional view of the embodiment of FIG. 1 as taken along Section II—II thereof.
Figure 3:
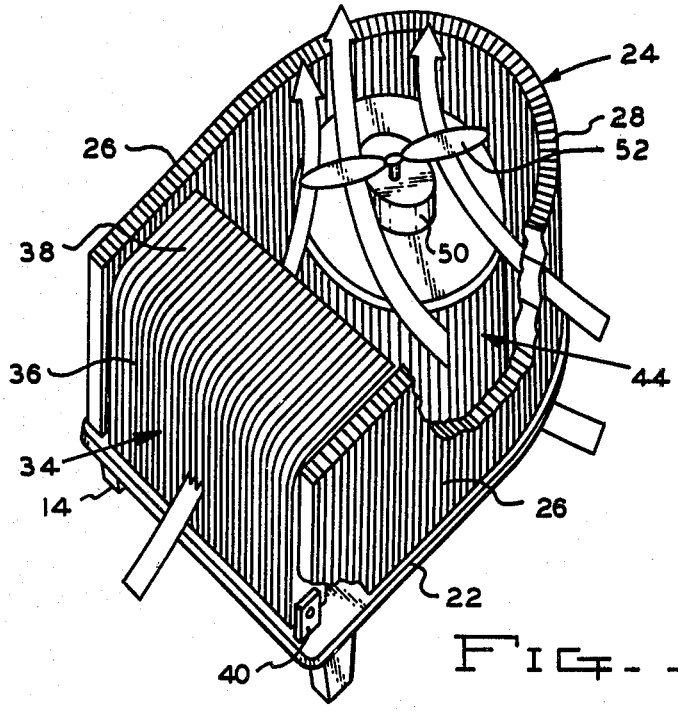
FIG. 3 is a perspective view of the condenser of FIG. 1 illustrating the arrangement of the heat exchanging coils, the sheet metal condenser shrouds having seen removed.

With reference to FIGS. 1–3, a condenser for a compressor type refrigeration system is generally indicated at 10. This type of condenser is widely used with home central air conditioning units, and is usually located exteriorly of the dwelling adjacent an outer wall. The condenser assembly includes a flat base 12 supported upon legs 14 whereby the base will be vertically located above the supporting pad surface 16 to permit the free flow of air below the base, FIG. 2. The base 12 includes an inner or central region 18 provided with an air opening 20 for a purpose later described.

A pair of air cooled refrigerant condensing heat exchanging coils are mounted upon the base adjacent the peripheral flange 22 thereof. The coil 24 is of a U-configuration having planar portions 26 interconnected by an arcuate portion 28. The coil 24, as are the other coils mounted upon the base 13, may be of any of the typical refrigerant condenser coil constructions, usually consisting of one or more tubes or conduits 30 bonded or expanded to fin elements 32 to increase the air contact area in order to produce an effective heat exchanging relationship between the refrigerant within the tubes and the surrounding air. The condenser fins 32 are oriented such that air may flow through the coil at right angles to the length of the tubes 30 and the general configuration of the coil plane or form.

A displaceable condenser refrigerant air cooled coil 34 is mounted intermediate the portions 26 to complete an outer loop as will be appreciated from FIGS. 2 and 3. The coil 34 includes a vertical loop closing extending portion 36, and a horizontally disposed portion 38 as to be of an L-configuration. The coil 34 is, likewise, formed of tubes and fins, and the portion 36 is mounted adjacent the bas periphery by a hinge bracket 40, FIG. 3 3 to provide servicing access to the compressor.

The coils 24 and 34 constitute the outer or exterior coils of the condenser configuration, and form the outer "wall" of a chamber 42 defined within the condenser form.

An inner air cooled refrigerant condenser heat exchanger coil 44 is mounted upon the base 12, and the coil 44 is shown of a cylindrical configuration formed of tubes and fins whereby the flow of air therethrough will cool the refrigerant within the tubes. The coil 44 is supported upon the base substantially concentrically to the base opening 20 whereby the chamber 46 defined by the coil is closed by a cover plate 48, and an electric motor 50 may be mounted upon the cover for driving the fan impeller 52 to force air in an upward direction, FIG. 2.

As apparent in FIG. 2, the L-configuration of the coil 34, and the spacing between the coil portion 28 and the inner coil 44 permits a refrigeration compressor 54 to be mounted upon the base 13 below the coil portion 38. The compressor controls 56 may also be located in this portion of chamber 42, and space exists for the other refrigeration system components normally associated with the condenser housing.

Sheet metal shrouds 58 and cover 60 are mounted upon the base, FIGS. 1 and 2, to enclose portions of the heat exchanging coils and apparatus mounted upon the base. As will be appreciated, such sheet metal work includes louvers 62 whereby an unrestricted flow of air through both portions of coil 34 is permitted, and a circular screened opening 64 concentric with the fan 52 is defined in cover 60 which protects the fan and permits an upward flow of air as discharged by the fan. Preferably, the outer surface of the coil 24 is directly exposed to the atmosphere, FIG. 1, and louvers are not required and air may directly enter the coil 24.

Energizing of the motor 50 and fan 52 will produce the air flow path through the condenser 10 as illustrated by the arrows of FIG. 3. As the air is exhausted from the chamber 42 by the fan, air is simultaneously drawn through the fins of coil 24, and through both portions 36 and 38 of coil 34. As the coils 24 and 34 define the entire vertical dimension of the chamber 42, and the coil portion 38 defines a part of the horizontal definition of the chamber 42 all air being drawn into the chamber 42 by fan 52 is passing through a heat exchanger coil for refrigerant condensing purposes.

Additionally, the drawing of air from the chamber 42 produces air flow into the chamber 46 through opening 20, as the air within chamber 46 is drawn into chamber 42, for exhausting through the cover opening 64. The spacing between the inner coil 44 and the coil portion 28 is sufficient to permit a relatively smooth non-turbulent air flow in chamber 42, and the clearance between the coils and the compressor apparatus mounted upon the base 12 likewise permits relatively unrestricted air flow through all of the coils.

The aforedescribed heat exchanging coil configuration permits a single air mover to draw air through three separate heat exchanging condensing coils, and it will be readily appreciated that the disclosed apparatus is capable of producing large condensing capacities in a relatively concise configuration. The illustrated D-shape of condenser 10 is somewhat similar to condensers presently available which use only a single U-shaped coil, and by the use of the plurality of heat exchanging coils described high condensing rates may be achieved with a minimum of consumption of electrical energy by the air mover.

in the embodiment of FIGS. 1–3, the chamber 42 performs as a common inlet air duct leading to the air mover, that is, the chamber 42 is common to both the exterior closed loop and the interior closed loop defined by the face areas of the total condenser structure.

The air drawn into the opening 20 by the fan 50 passes radially outward through the interior closed loop defined by the face area of the coil 44 into the common air inlet duct provided by the chamber 42.

The exterior coils 24 and 34 together form a substantially closed exterior face area loop through which cooling air is drawn radially inward into the common air inlet chamber 42, the chamber 42 embracing the coil 44 as well as the compressor 54. In general, the direction of air flow through the opening 20 into the chamber 42 is opposed to the radially inward air flow through the face area of the exterior loop defined by the coils 24 and 34 into the chamber 42.

Maintenance of the compressor 54, FIG. 2, is accomplished by pivoting the coil 34 about its pivot hinge bracket 40 whereby the coil may be rotated in a counterclockwise direction to provide access to the compressor after the cover plate 60 has been removed. Suitable fluid connections, not shown, permit pivotal displacement of the coil 34.

Figure 4:
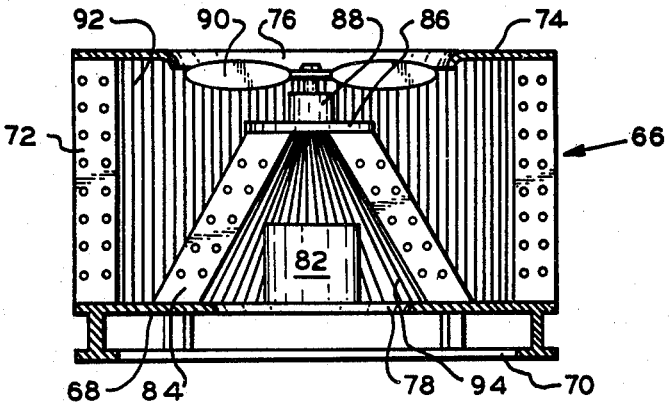
FIG. 4 is a diametrical, elevational, sectional view of another embodiment of refrigeration condenser configuration in accord with the invention.
Figure 5:
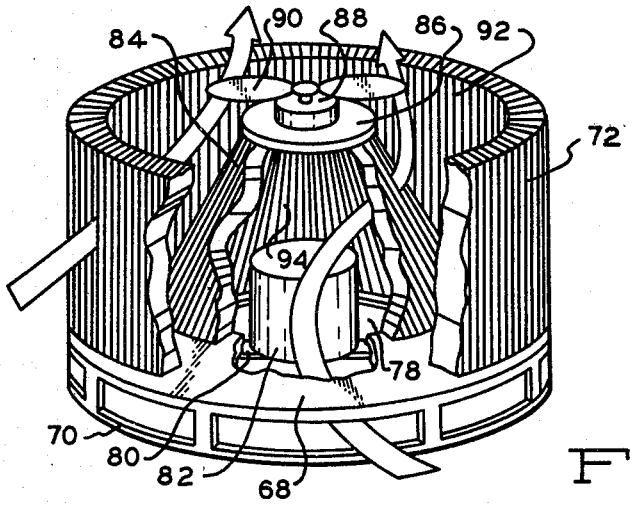
FIG. 5 is a perspective view, partially broken away, of the condenser apparatus of FIG. 4 illustrating the air flow paths.

In the embodiment of FIGS. 4 and 5 the condenser generally indicated at 66 is of a cylindrical configuration and includes a base 68 supported upon an open support structure 70 whereby atmospheric air may readily enter the space below the base. A cylindrical air cooled heat exchanging coil 72 is mounted upon the base and defines the vertical dimension of the condenser and the general appearance. Suitable tubes and conduits communicate with the coil 72, not shown, whereby the refrigerant to be condensed circulates through the coil.

The upper end of the coil 72 is enclosed by the cover plate 74 having a concentric air outlet opening 76 defined therein.

The base 68 is provided with a central opening 78, and a support bracket 80 extends across the opening 78 upon which the refrigeration compressor 82 is mounted.

An inner air cooled refrigeration condensing coil 84 is mounted upon the base 68 within coil 72, and, preferably, the coil 84 is of a truncated pyramidal configuration having four substantially planar sides interconnected by arcuate corners. The upper end of the coil 84 is closed by cover plate 86, and the electric motor 88 driving fan 90 is mounted upon this cover plate.

The coil 72 defines a chamber 92 within the condenser configuration, and the coil 84 defines chamber 94 in which the compressor 82 is mounted. Energizing of the motor 88 and fan 90 to force air upwardly through outlet opening 76 will draw air simultaneously through the coil 72 and the coil 84 as indicated by the arrows of FIG. 5. Accordingly, in the embodiment of FIGS. 4 and 5 a single air motor draws air through two coils, and the truncated pyramidal configuration of coil 84 permits an unrestricted flow of air into the chamber 92, while providing a large coil surface exposed to the air flowing through base opening 78 If desired, the coil 84 can be of conical, rather than pyramidal, configuration, or the coil could be of a cylindrical form such as shown in FIG. 2.

It will be appreciated that the face areas of the coils 72 and 84 define nested closed loops and that the chamber 92 functions as a common air inlet for the cooling air being drawn through the coils 72 and 84 by the fan 90, the air flow being radially inward through the coil 72 into the chamber 92 and radially outward through the coil 84 into the chamber 92. Thus, as in the case of the embodiment of FIGS. 1–3, the total face areas of the condenser structure is functioning at maximum efficiency.

The coil 84 is mounted upon the base 68 by removable bracket means, not shown, whereby the disconnecting of such brackets permits the coil to be removed to provide maintenance access to the compressor 82, and for this purpose flexible conduits or hose, not shown, may be used to connect the coil to the refrigeration system.

Figure 6:
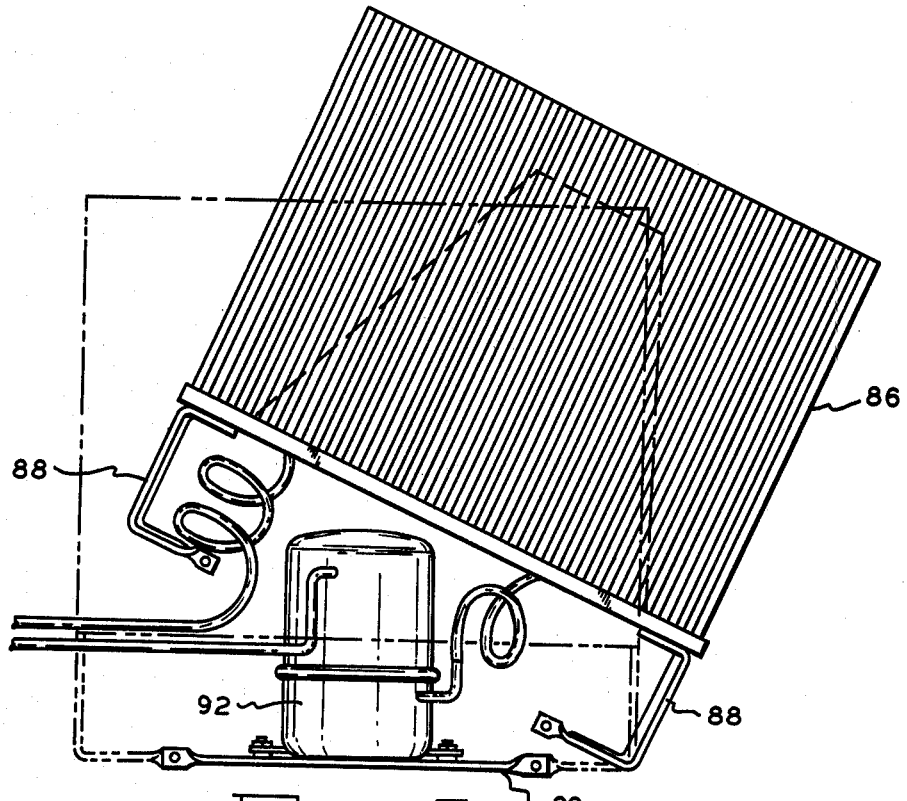
FIG. 6 is a side elevational view of an embodiment similar to FIG. 4 showing the nested loops displaced to service the compressor.

In FIG. 6, the nexted loops of the condenser unit 86 are shown mounted on a suitable support having legs 88 which when unbolted from the compressor base 90 permits the unit 86 to be tilted to service the compressor 92.

Figure 7:
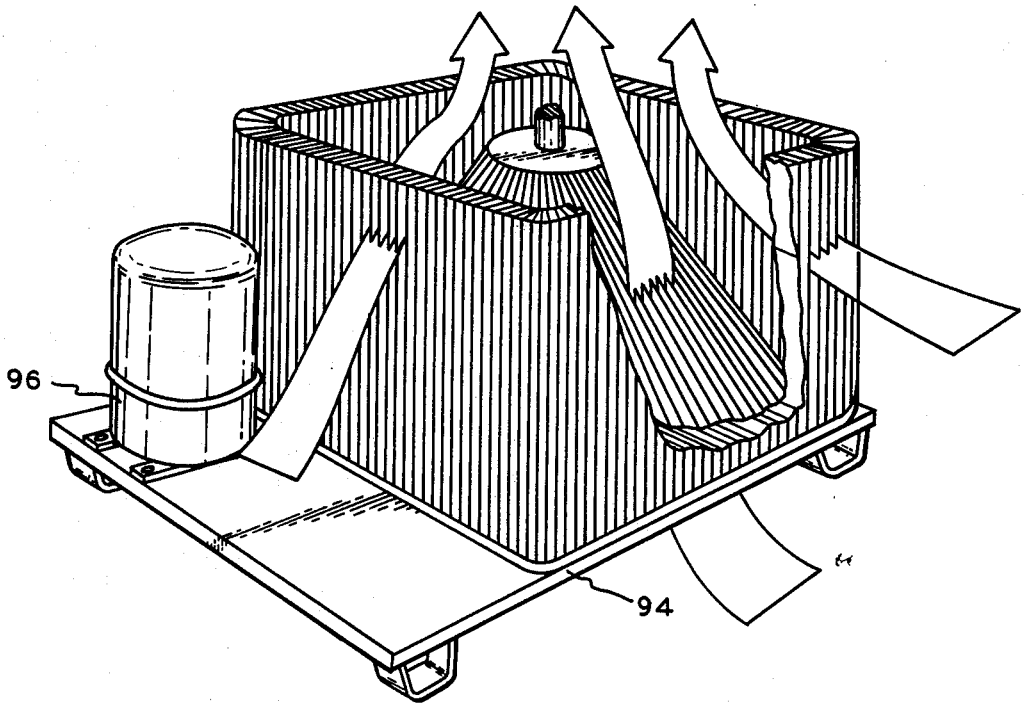
FIG. 7 is a modification of FIG. 4 in which the compressor is shown mounted outside the nested loops.

FIG. 7 illustrates a modification of the nested loops of FIG. 4 supported on a base 94 which has been enlarged to enable the compressor 96 to be mounted outside the loops of the coils for servicing.

From the above descriptions it will be appreciated that the condenser constructions described fulfill the objects of the invention permitting maximum condensing capacities in concise configurations while achieving cooling with a low expenditure of electrical power and producing high energy efficient ratings.

It is appreciated that various modifications to the inventive concepts may be apparent to those skilled in the art without departing from the spirit and scope of the invention.

I claim:

1. A condenser unit for air conditioning systems characterized by reduced cubic volume and high energy efficiency ratio comprising, in combination, a first annular closed loop heat exchanger coil having an outer side exposed to ambient air and an inner side defining a first chamber, a second annular closed loop heat exchanger coil within said first chamber having an inner side exposed to ambient air and an outer side communicating with said first chamber, said second coil defining a second chamber distinct from said first chamber, and a fan communicating with said first chamber inducing air flow through said first and second coils in opposed directions with respect to said inner and outer sides of said respective coils whereby ambient temperature air passes through each coil.

2. A condenser unit as defined in claim 1 wherein a compressor is located within said second coil.

3. A condenser unit as defined in claim 2 wherein said second coil is displaceable to service said compressor.

4. A condenser unit for all conditioning systems comprising, in combination, a base having a periphery and an inner region, outer flow-through air cooled coil means mounted on said base including a first heat exchanging closed loop coil defining a first chamber and having an air ingress side exposed to ambient air and an air egress side disposed toward said chamber and base inner region, inner flow-through air cooled closed loop coil means mounted on said base inner region within said outer coil means and first chamber defining a second chamber distinct from said first chamber, said second chamber being separated from said first chamber by said inner coil means, an opening formed in said base inner region, said inner coil means including a second heat exchanging coil having an air ingress side communicating with said opening and an air egress side communicating with said first chamber defined by said outer coil means, said first coil egress side communicating with said first chamber, and a motor driven fan for inducing air flow through said first chamber and through said first and second coils cooling the same, said first chamber defining an air flow passage directly establishing communication between said fan and said first and second coils whereby air passing through said first coil directly passes to said fan and air passing through said second coil has not previously passed through said first coil.

5. A condenser unit as defined in claim 4, said fan constituting an exhaust fan and said opening constituting an air inlet into said second chamber whereby said fan simultaneously draws air through said first and second coils.

6. A condenser unit as defined in claim 4, said inner coils means comprising an annular heat exchanging coil having an upper edge and a lower edge, said lower edge being located adjacent said base and a cover extending over said upper edge, said coil and cover defining said second chamber.

7. A condenser unit as defined in claim 6, a compressor mounted upon said base within said second chamber and within said inner coil means.

8. A condenser unit as defined in claim 6 wherein said inner heat exchanging coil is of a cylindrical configuration.

9. A condenser unit as defined in claim 6 wherein said inner heat exchanging coil is of a truncated pyramidal configuration.

10. A condenser unit as defined in claim 4 wherein said outer coil means includes a U-shaped coil having an open throat and a second displaceable coil located within said first coil throat wherein said second coil increases the heat exchanging area of said first coil means by providing a closed loop.

11. A condenser unit as defined in claim 4 wherein said first coil is of a substantially cylindrical configuration and said second coil is of a truncated pyramidal configuration.

12. A condenser unit as defined in claim 4 wherein a compressor is located upon said base.

13. A condenser unit as defined in claim 12 wherein one of said coils is displaceable for compressor servicing.

* * * * *